US010195808B2

(12) United States Patent
Fischer et al.

(10) Patent No.: US 10,195,808 B2
(45) Date of Patent: Feb. 5, 2019

(54) COMPACTING APPARATUS FOR COMPACTING RECEPTACLES

(71) Applicant: WINCOR NIXDORF INTERNATIONAL GMBH, Paderborn (DE)

(72) Inventors: Axel Fischer, Ilmenau (DE); Matthias Neuland, Ilmenau (DE); Patrick Rhein, Ilmenau (DE); Stephan Springsguth, Langewiesen (DE)

(73) Assignee: Wincor Nixdorf International, GmbH, Paderborn (DE)

( * ) Notice: Subject to any disclaimer, the term of this patent is extended or adjusted under 35 U.S.C. 154(b) by 1225 days.

(21) Appl. No.: 14/446,811

(22) Filed: Jul. 30, 2014

(65) Prior Publication Data

US 2015/0033960 A1 Feb. 5, 2015

(30) Foreign Application Priority Data

Jul. 31, 2013 (EP) ..... 13178778

(51) Int. Cl.

| | |
|---|---|
| ***B30B 9/32*** | (2006.01) |
| ***B30B 15/06*** | (2006.01) |
| ***B30B 15/32*** | (2006.01) |
| ***B30B 1/30*** | (2006.01) |
| ***B30B 12/00*** | (2006.01) |
| ***B30B 15/30*** | (2006.01) |

(52) U.S. Cl.

CPC ..... *B30B 9/321* (2013.01); *B30B 1/30* (2013.01); *B30B 9/325* (2013.01); *B30B 12/00* (2013.01); *B30B 15/068* (2013.01); *B30B 15/30* (2013.01); *B30B 15/32* (2013.01); *Y10S 100/902* (2013.01)

(58) Field of Classification Search

CPC ..... B30B 9/321; B30B 9/325; B30B 1/30; B30B 15/30; B30B 15/32; B30B 12/00; B30B 15/068; B30B 3/02; Y10S 100/902; B26F 1/24; B26F 2210/11

USPC ..... 100/210, 902

See application file for complete search history.

(56) References Cited

U.S. PATENT DOCUMENTS

| | | | | |
|---|---|---|---|---|
| 2,675,970 A | | 4/1954 | Edwards | |
| 4,091,725 A | | 5/1978 | Arp | |
| 4,358,995 A | * | 11/1982 | Ballo | B30B 9/325 100/100 |

(Continued)

FOREIGN PATENT DOCUMENTS

| | | |
|---|---|---|
| DE | 2516683 | 12/1975 |
| DE | 102006031970 | 1/2008 |

(Continued)

*Primary Examiner* — Jimmy T Nguyen

(74) *Attorney, Agent, or Firm* — Black, McCuskey, Souers & Arbaugh, LPA

(57) ABSTRACT

A compacting apparatus (1) for compacting receptacles has at least one advancing device (2) for conveying a receptacle (G) in a conveying direction (E) to an exit opening (6) of the compacting apparatus (1). The at least one advancing device (2) is configured to act on the receptacle (G) for compacting during conveying. A flap device (5) has an adjustable retaining flap (50) that closes the exit opening (6) in a closed position so that a receptacle (G) conveyed against the retaining flap (50) by the at least one advancing device (2) is retained on the retaining flap (50). The retaining flap (50) is adjustable out of the closed position to release the exit opening (6).

11 Claims, 5 Drawing Sheets

(56) References Cited

U.S. PATENT DOCUMENTS

| | | | | |
|---|---|---|---|---|
| 5,195,429 | A | 3/1993 | Firpo | |
| 5,558,284 | A * | 9/1996 | Baumung | B02C 19/0081 241/101.741 |
| 5,642,661 | A * | 7/1997 | Tu | B30B 9/322 100/216 |
| 2003/0010598 | A1 | 1/2003 | Kiva et al. | |

FOREIGN PATENT DOCUMENTS

| | | |
|---|---|---|
| DE | 202009016107 | 3/2010 |
| EP | 0397158 | 11/1990 |
| GB | 1468662 | 3/1977 |
| JP | 57-65796 | 10/1955 |
| JP | 54-44477 | 3/1979 |
| JP | 61-49693 | 4/1986 |

* cited by examiner

COMPACTING APPARATUS FOR COMPACTING RECEPTACLES

BACKGROUND

1. Field of the Invention

The invention relates to a compacting apparatus for compacting receptacles and to a method for operating a compacting apparatus.

2. Description of the Related Art

A compacting apparatus for compacting receptacles comprises at least one advancing device for conveying a receptacle in a conveying direction to an exit opening of the compacting apparatus. The at least one advancing device is configured to act on the receptacle for compacting during conveying. Such a receptacle may be for example a disposable plastics bottle (such as a PE or PET bottle) or a beverage can.

A compacting apparatus of this type is used with a reverse vending machine via which a consumer can deliver empties, for example in a shop, in exchange for the refund of a deposit. A reverse vending machine in this case accepts empties in the form of receptacles, for example disposable plastics bottles or beverage cans, and feeds this receptacle to a compacting apparatus that compacts the receptacle.

In the context of this text, the term "compacting" is understood to mean the reduction in volume of a receptacle. Compacting allows space-saving storage and easy, cost-effective transport of receptacles as a result of the reduced volume. Additionally, in accordance with requirements for example of the Deutsche Pfandsystem GmbH (DPG), upon the return of receptacles the receptacle itself or check markings attached to the receptacle should be destroyed so that it is not possible to return the receptacle to a noncompacted state and thus to insert the receptacle into a reverse vending machine again.

DE 101 14 686 C1 discloses an apparatus in which a receptacle is fed via a vane shaft to a spiked roller that bears spikes to irreversibly perforate the receptacle.

DE 10 2006 033 615 A1 discloses a compacting apparatus in which a receptacle is fed to a roller with blades on its outer lateral surface to perforate and destroy an introduced receptacle.

The compacting apparatus of DE 10 2009 049 070 A1 has two rollers with rotation axes that extend parallel to one another. The rollers bear strips that extend in an undulating manner on their outer lateral surfaces. These strips are intended to improve the draw-in behavior for receptacles and compacting.

JP 2005-111552 A discloses a compacting apparatus having two chain drives that convey a receptacle in an advancing direction and as a result compact it. The compacting apparatus acts in this case unidimensionally in that the receptacle is conveyed between the diametrically opposed advancing devices. An input hopper is arranged above the compacting apparatus into which receptacles are intended to be inserted. The input hopper has a feed opening above the compacting apparatus.

Known compacting apparatuses frequently are constructed in a multistage manner, in that a post-compacting unit follows a precompacting unit. Such compacting apparatuses generally act unidimensionally, in that receptacles are pressed flat in one spatial direction and in the process are destroyed. This results in a comparatively complicated multistage construction with a considerable installation space requirement.

There is a need for a compacting apparatus that allows both a high compacting rate and a high compacting factor, that is to say a large volume reduction, while having simultaneously reliable operation with a long service life.

The compacting rate is defined as the maximum number of compactable receptacles per minute and determines the overall performance of a receptacle return system, because a single compacting apparatus downstream of the reverse vending machine downstream can accept receptacles only at the speed at which the downstream compacting apparatus can compact the receptacles.

The invention is based on the object of providing a compacting apparatus for compacting receptacles and a method for operating such a compacting apparatus, allowing an increase in the compacting factor by way of simple structural means, optionally with the use of already existing advancing devices, for example rollers, cutting units, chain drives or the like.

SUMMARY OF THE INVENTION

The invention relates to a compacting apparatus that has a flap device with an adjustable retaining flap that closes the exit opening in a closed position so that a receptacle conveyed against the retaining flap by the at least one advancing device is retained on the retaining flap. The retaining flap is adjustable out of the closed position to release the exit opening.

The invention is based on the idea of providing an additional device downstream in the region of the advancing device or in the conveying direction of the advancing device, said additional device being able to ensure retention of a receptacle conveyed by the advancing device. To this end, provision is made of a flap device which closes the exit opening of the compacting apparatus, through which a receptacle is intended to be conveyed, in a closed position such that a conveyed receptacle cannot readily pass through the exit opening, but is retained at the retaining flap of the flap device. In conjunction with the conveying action of the advancing device, this results, at the retaining flap, in compression of the receptacle in the conveying direction, this being able to increase the compacting factor by shortening the receptacle in the longitudinal direction.

The compacting apparatus thus achieves compacting in at least two spatial directions.

First, compacting is effected transverse to the conveying direction by the advancing device, for example a cutting unit as is known from DE 10 2006 033 615 A1. The receptacle is compressed and pressed transverse to the conveying direction and, in the process, the receptacle optionally is perforated, for example by suitable piercing tools.

Second, on account of the compressive action of the retaining flap, compression is achieved in the conveying direction so that the receptacle is shortened in the direction of its axial longitudinal extent.

This compression effect is particularly effective when a receptacle is transported with its longitudinal axis longitudinally in the conveying direction in the compacting apparatus. In this case, the axial compression takes place along the longitudinal axis of the receptacle.

In the closed position, the retaining flap closes the exit opening and thus causes an accumulation at the exit opening. The retaining flap is adjustable out of the closed position to release the exit opening and to allow a compacted receptacle to pass through the exit opening and thus out of the compacting apparatus. In this case, the retaining flap can be adjustable in any desired manner between its closed position and an open position releasing the exit opening. In an advantageous configuration, the retaining flap is for example pivotable about a pivot axis and can thus be pivoted out of its closed position.

Preferably, the retaining flap is pretensioned in the direction of the closed position by a suitable pretensioning device. The pretensioning device can be realized for example in a spring-mechanical manner using one or more spring elements that pretension the retaining flap in a spring-elastic manner in the direction of the closed position and thus hold it in the closed position.

The pretensioning device can be dimensioned to set a predetermined limit force that has to be overcome to open the retaining flap from its closed position. Only when a force exerted on the retaining flap by a receptacle exceeds the predetermined limit force does the retaining flap open automatically so that a receptacle can pass through the exit opening.

During operation, a receptacle is conveyed against the retaining flap in a manner driven by the advancing device and as a result is compressed. The farther a receptacle is conveyed toward the retaining flap and the greater the proportion of the receptacle that is retained between the advancing device and the retaining flap, the greater the force with which the receptacle retained at the retaining flap presses against the retaining flap. Only when this force becomes so great that the predetermined limit force is exceeded does the retaining flap open and thus allows the receptacle to pass through, wherein the limit force is preferably so great that effective compression of the receptacle in the conveying direction can be achieved.

The pivot axis of the retaining flap can be offset with respect to the exit opening counter to the conveying direction. In this case, the retaining flap has a flap portion that closes the exit opening in the closed position and that is connected via at least one arm to a bearing element for pivotably mounting the retaining flap on a housing of the compacting apparatus. Since the pivot axis of the retaining flap is offset with respect to the exit opening counter to the conveying direction, the adjusting direction in which the retaining flap is intended to be moved out of the closed position to release the opening is not directed in the conveying direction but obliquely or even perpendicularly thereto. In this way, it is possible for a pretensioning device to be dimensioned in a comparatively small manner in order to provide a comparatively low retaining force, because a force applied to the retaining flap by a receptacle does not act entirely in the direction of the adjusting direction of the retaining flap and thus does not contribute entirely to the opening of the retaining flap but only with a direction vector component.

However, in this case the flap portion is oriented with respect to the conveying direction in which the compacting apparatus conveys a receptacle against the flap portion during operation, for example in an inclined manner. Thus, a receptacle conveyed against the flap portion exerts a force action on the flap portion, and the force action is directed at least with a direction vector component in an adjusting direction in which the retaining flap is intended to be adjusted out of the closed position. The force exerted by a receptacle on the retaining flap acts, at least with a direction vector component, in the direction of the adjusting direction and thus in the direction of opening of the retaining flap. Therefore, the opening of the retaining flap can take place automatically due to the force action of a receptacle pressed against the retaining flap.

A direction vector component should be understood here as meaning a component of a direction vector of a force that acts on the retaining flap. The direction vector of the force can be broken down into vector components, as known from vector analysis. At least one of these vector components is intended to act in the direction of the adjusting direction of the retaining flap.

In an advantageous configuration, the exit opening is formed between two guide plates for guiding a receptacle. The guide plates form between one another a storage space into which the receptacle is intended to be conveyed, wherein the flap portion of the retaining flap bounds the storage space on the outlet side.

In an advantageous configuration, for example when the advancing device is realized by a cutting unit, as known for example from DE 10 2006 033 615 A1, one of the guide plates can also be configured as a stripping tool that interacts with the advancing device for advantageously separating a receptacle from the advancing device. The guide plate can in this case be arranged for example in such a spatial position with respect to the advancing device that the advancing device conveys a receptacle toward the guide plate and the guide plate acts in a stripping manner so that a receptacle conveyed in the direction of the guide plate runs onto the guide plate and as a result is detached from the advancing device, in particular from piercing or cutting tools of the advancing device.

The guide plates may be arranged in a fixed position on a housing of the compacting apparatus. The receptacle is conveyed into the storage space formed between the guide plates and is retained there by the retaining flap located in the closed position. On account of the retaining action of the retaining flap, compression of a receptacle conveyed into the storage space occurs in the conveying direction, wherein, when the force exerted on the retaining flap by the receptacle exceeds the predetermined limit force, the retaining flap opens automatically and thus the receptacle can be ejected through the exit opening.

The flap portion of the retaining flap can be formed, for example, by spaced-apart blocking bars that block the exit opening in the closed position. By way of the blocking bars, the flap portion engages through one of the guide plates that has slots in which the blocking bars of the flap portion are movable. The flap portion thus meshes with the guide plate by way of its blocking bars and is adjustable in its adjusting direction with respect to the guide plate so that the flap portion can be moved between its closed position and its open position.

The flap portion can, for example, describe in the closed position an angle of greater than 90° with a line that points through the pivot axis of the retaining flap and through a point of action of the flap portion on which a receptacle conveyed against the flap portion acts. If the adjusting direction of the flap portion is directed for example at least approximately perpendicularly to the conveying direction, with such an inclination of the flap portion a force component can still act in the direction of the adjusting direction. This is because the force effected by the receptacle on the retaining flap acts perpendicularly on the flap portion. Because the flap portion in this case describes an angle of greater than 90° with the line that points through the pivot axis and the point of action, at least one component of the force acts in the direction of the adjusting direction.

The point of action can be for example the point at which a force effected by a receptacle bears on average and acts on the flap portion.

The advancing device can be configured in principle in any desired manner. In particular, one or more advancing devices can be provided.

For example, use can be made of a cutting unit of the type in DE 10 2006 033 615 A1. Alternatively, advancing devices in the form of advancing screws or advancing devices that use traction elements such as belts, bands, chains, cables or the like, that is to say flexible traction elements that are configured (only) to transmit tractive forces, can be used. Advancing devices of the advancing screw type are known for example from U.S. Pat. No. 5,102,057. Advancing devices that use chains or bands, that is to say traction elements that transmit tractive forces, are known for example from JP 2005-111552 A and JP 2004-223609 A.

The invention also relates to a method for operating a compacting apparatus for compacting receptacles. The compacting apparatus has at least one advancing device for conveying a receptacle in a conveying direction to an exit opening of the compacting apparatus and acts on the receptacle for compacting during conveying. In this case, provision is made for a flap device having an adjustable retaining flap to close the exit opening in a closed position such that a receptacle conveyed against the retaining flap by the at least one advancing device is retained on the retaining flap, wherein the retaining flap is adjusted out of the closed position to release the exit opening.

The advantages and advantageous configurations described above for the compacting apparatus are also applied in an analogous manner to the method, and so reference should be made to what was stated above.

The invention is explained in more detail in the following text by way of the exemplary embodiments illustrated in the figures.

DETAILED DESCRIPTION

Figure 1:
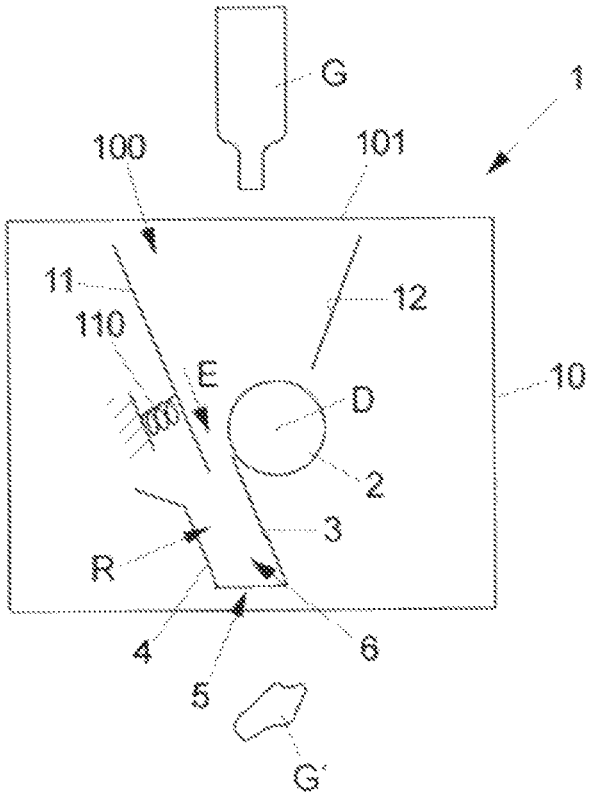
FIG. 1 is a schematic illustration of a compacting apparatus.

FIG. 1 is a schematic illustration of a compacting apparatus 1 with a housing 10 and an advancing device 2 arranged therein, for example in the form of a roller or the like.

An insertion hopper 100 is formed by guiding surfaces 11, 12 and a receptacle G can be inserted therein. The advancing device is rotatable about a rotation axis D and conveys the receptacle G in a conveying direction E and in the process compacts the receptacle G, thus reducing its volume, by compression of the receptacle G transverse to the conveying direction E. To this end, the guiding surface 11 can be mounted in a resilient manner with respect to the housing 10 by a pretensioning device 110. The advancing device 2 conveys the receptacle G in the conveying direction E into an intermediate space between the guiding surface 11 and the advancing device 2 and in the process compresses it.

Guide plates 3, 4 are arranged downstream of the advancing device 2 in the conveying direction E and a storage space R is formed between the guide plates 3, 4 for receiving the receptacle G conveyed by the advancing device 2. The compacting apparatus 10 has an exit opening 6 on the outlet side of this storage space R, and a compacted receptacle G' passes through the exit opening 6 to be ejected from the compacting apparatus 1.

A flap device 5 is arranged at the exit opening 6 and can close the exit opening 6 so that a receptacle G cannot pass through the exit opening 6 but rather is retained at the flap device 5. In this way, it is possible, following compacting by the advancing device 2 and the guiding surface 11, for a receptacle G to additionally be compressed at the flap device 5 and as a result also to be longitudinally shortened in the longitudinal direction in the conveying direction E so that the receptacle G is compacted further down to the compacted receptacle G'. Thus, compared with the original receptacle G, the compacted receptacle G' is compressed both transverse to its longitudinal direction and in its longitudinal direction, so that a compact, for example approximately spherical or cuboidal or accordion-like shape of the compacted receptacle G' can result.

A specific configuration of a flap device 5 is illustrated in an exemplary embodiment in FIGS. 2 to 5.

In the exemplary embodiment, the advancing device 2 is formed by a cutting unit of the type in DE 10 2006 033 615 A1, although this should not be understood in a limiting manner. In principle, the advancing device 2 can be configured in any desired manner to effect an advancing movement in the conveying direction E.

The advancing device 2 compacts a receptacle G (see FIG. 3) initially in a manner interacting with the guiding surface 11 transverse to the conveying direction E. Piercing tools 20 in the manner of hooks are formed on the advancing device 2. The hooks are used to pierce the receptacle G at least in a punctiform manner and thus achieve perforation, effective compacting and also effective transmission of advancing forces to the receptacle G. As a result of the perforation, it is possible for example for air to escape from the interior of the receptacle G so that the receptacle G can be compressed. The piercing of the piercing tools 20 into the receptacle G additionally produces what are known as interleaving cuts, which interleave the walls of the receptacle G with one another such that the receptacle G retains its compacted form and is not restored to its original form from the compacted form.

The advancing device 2 conveys a receptacle G into a storage space R located between guide plates 3, 4. The guide plate 4 has a guiding portion 40 which extends substantially parallel to the guide plate 3. The guide plates 3, 4 are each arranged in a fixed position on the housing 10 of the compacting apparatus 1.

Figure 5:
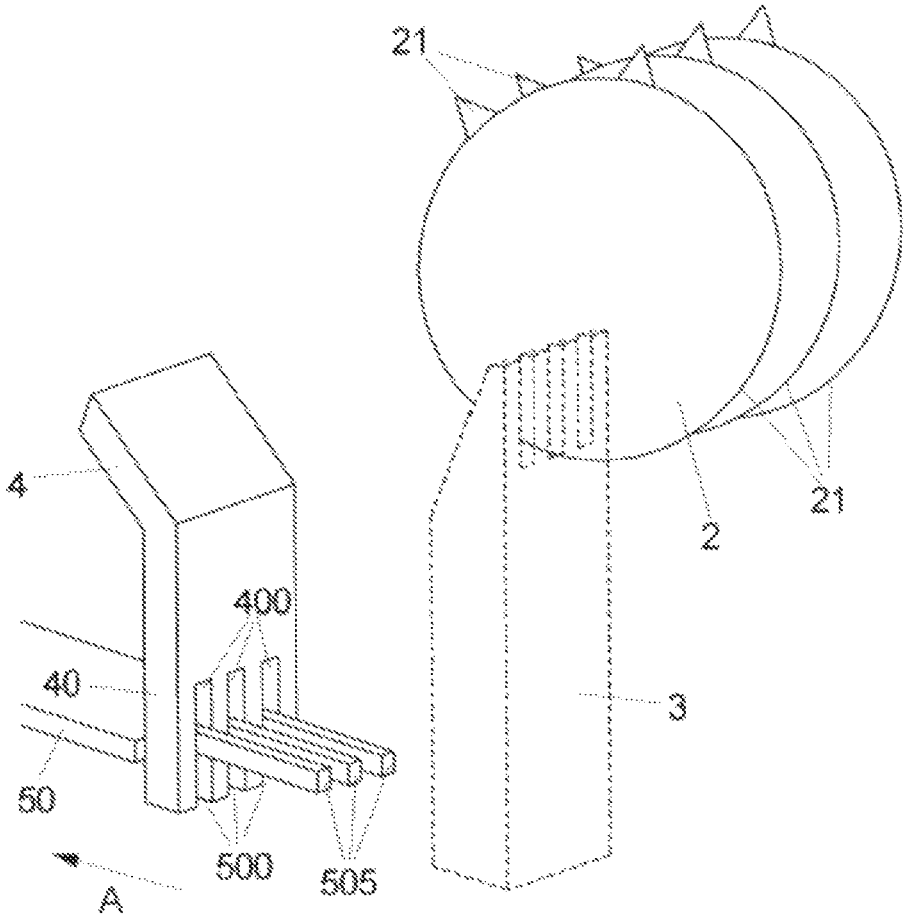
FIG. 5 is a schematic illustration of a flap portion of the flap device interacting with a guide plate.

The guide plate 3 also functions as a stripping tool and is in meshed engagement with disks 21 of the advancing device 2 (see FIG. 5). Thus, a receptacle G conveyed in the conveying direction E by the advancing device 2 runs onto the guide plate 3 and as a result is stripped from the advancing device 2.

As stated, the guide plates 3, 4 bound between one another a storage space R. In this case, the guide plates 3, 4 are arranged opposite one another transversely to the conveying direction E and enclose the storage space R, wherein the storage space R can furthermore be bounded by suitable walls of the housing 10 which extend (parallel to the plane of the drawing in the views according to FIGS. 2 to 4) between the guide plates 3, 4.

Figure 2:
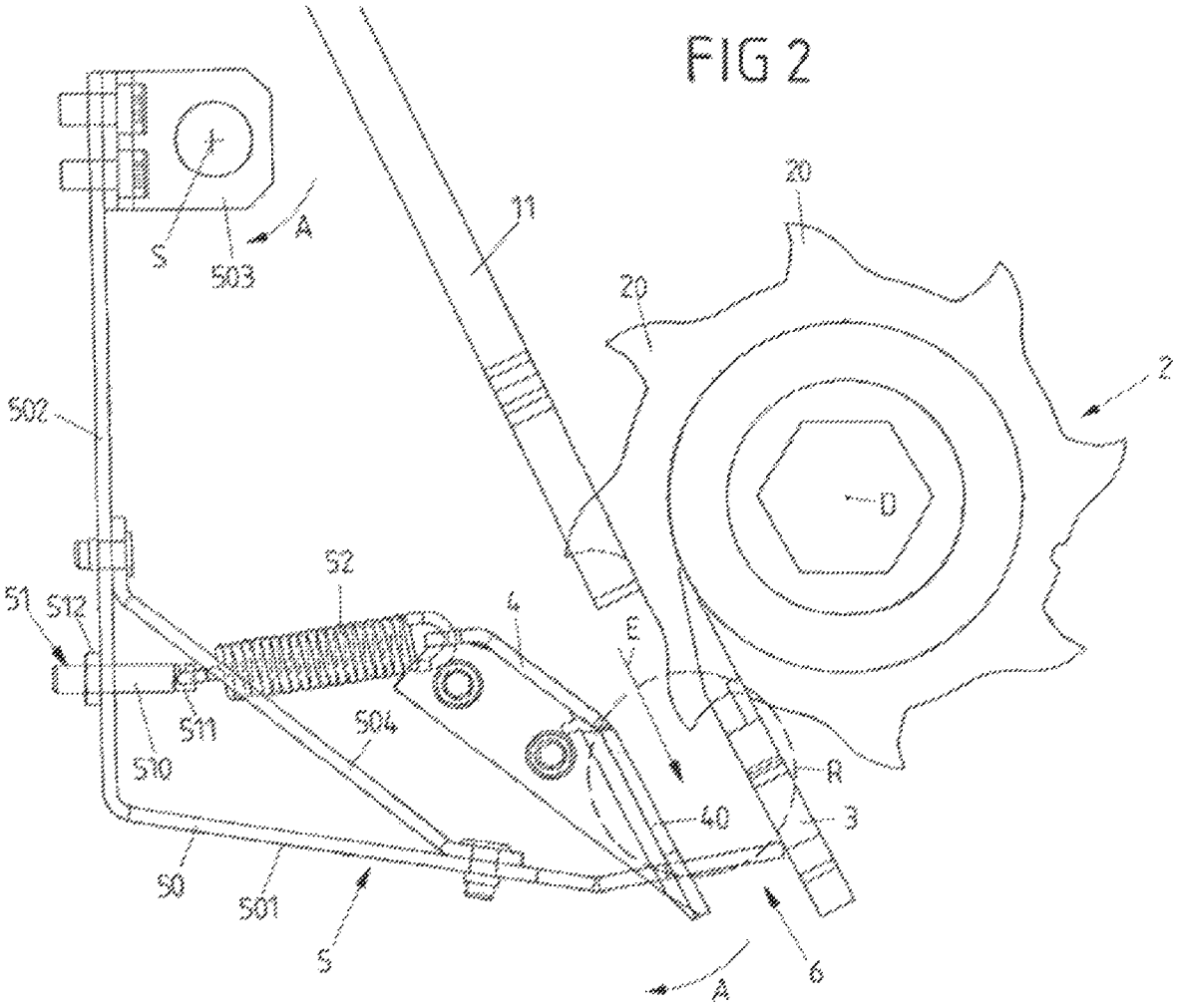
FIG. 2 is an elevational view of an advancing device interacting with a flap device.
Figure 3:
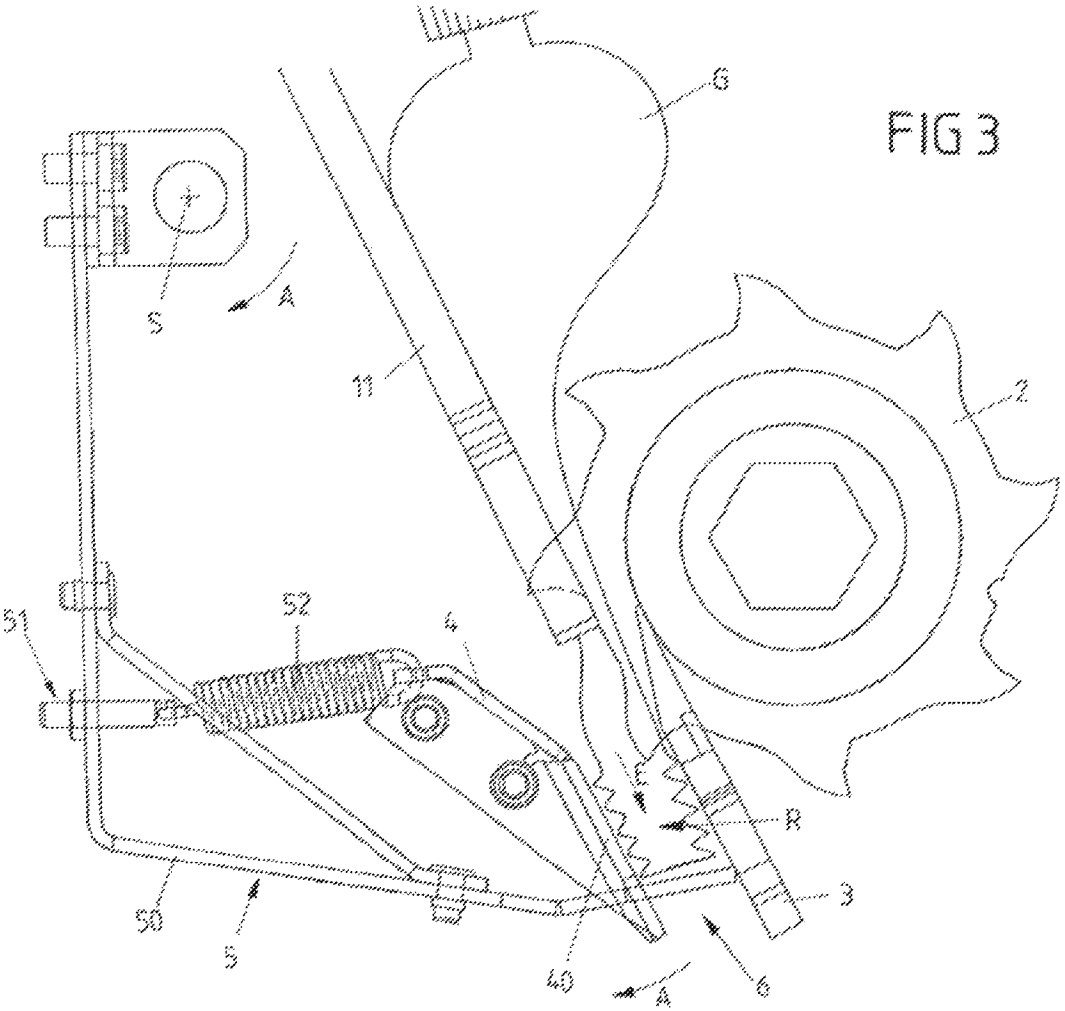
FIG. 3 is the view of FIG. 2, illustrating a receptacle conveyed toward the flap device.
Figure 4:
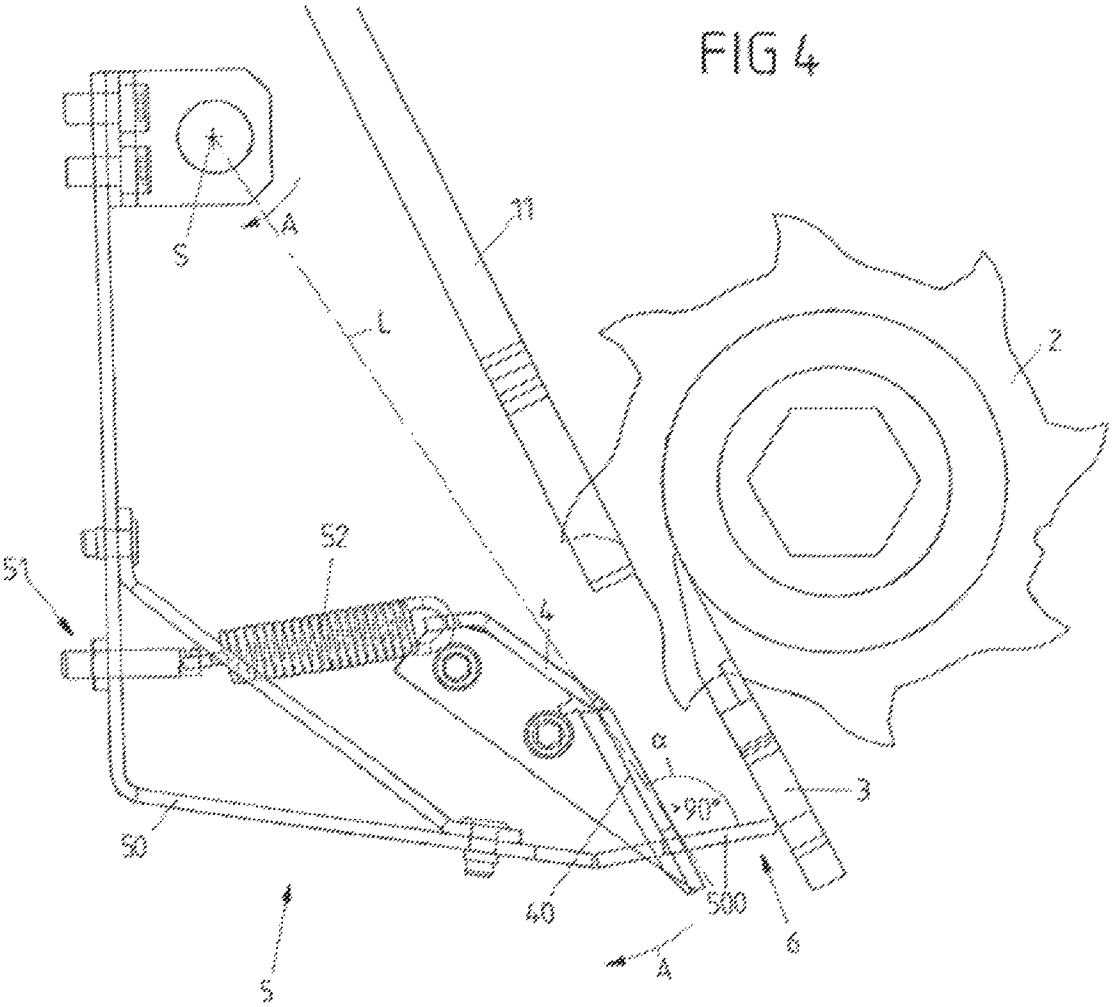
FIG. 4 is the view of FIG. 2, illustrating an angle between a flap portion and a line pointing through the pivot axis of the retaining flap.

On the outlet side, the guide plates 3, 4 form the exit opening 6 through which a receptacle G has to pass after it has been compacted, in order to leave the compacting apparatus 1. In an initial state, as illustrated in FIGS. 2 to 4, this exit opening 6 is closed by a flap portion 500 of a retaining flap 50 of the flap device 5, such that in this initial state it is not readily possible for a receptacle G to pass through the exit opening 6.

The flap portion 500 of the retaining flap 50 is connected, via arms 501, 502 which extend at an angle to one another and between which a stabilizing arm 504 for stabilizing the retaining flap 50 extends, to a bearing element 503 by means of which the retaining flap 50 is arranged on the housing 10 of the compacting apparatus 1 so as to be pivotable about a pivot axis S. About the pivot axis S, which is arranged in an offset manner with respect to the exit opening 6 counter to the conveying direction E, the retaining flap 50 can be pivoted out of its closed position in an adjusting direction A in order in this way to be transferred into an open position in which the exit opening 6 is released.

On account of the offset of the pivot axis S of the retaining flap 50 with respect to the exit opening 6 counter to the conveying direction E, the adjusting direction A is directed at least approximately transversely to the conveying direction E. Adjustment of the flap portion 500 out of the region of the exit opening 6 takes place in the adjusting direction A about the pivot axis S.

The retaining flap 50 is pretensioned with respect to the housing 10 by means of a pretensioning device 52 in the form of a (tension) spring element to be subjected to tensile loading, and in the specific configuration of the exemplary embodiment, is connected to the guide plate 4. The pretensioning device 52 acts on a setting device 51 which is arranged on the retaining flap 50 and by means of which the pretension of the retaining flap 50 relative to the housing 10 can be set. The setting device 51 has a setscrew 510 which is connected via one end 511 to the pretensioning device 52 in the form of the spring element and is held on the arm 502 of the retaining flap 50 via a nut 512. By adjusting the nut 512, the pretension can be set in that the distance of the end 511 from the guide plate 4 is varied in the closed position.

During operation, the advancing device 2 conveys a receptacle G, as is illustrated in FIG. 3, into the storage space R between the guide plates 3, 4, said storage space R being closed on the outlet side in the initial state by the flap portion 500 of the retaining flap 50 located in its closed position. On account of the retaining action of the flap portion 500, compression of the receptacle G at the flap section 500 thus occurs as a result of the conveying action of the advancing device 2, and thus also compacting longitudinally in the conveying direction E, as is illustrated in FIG. 3.

On account of the conveying force which the advancing device 2 exerts on the receptacle G, a force action on the flap portion 500 in the conveying direction E additionally occurs. This force action increases the further the advancing device 2 conveys the receptacle G into the storage space R, wherein the pretensioning device 52 pretensioning the retaining flap 50 defines a limit force, the exceeding of which causes the retaining flap 50 to open and thus to release the exit opening 6 for the receptacle G to pass through.

As is apparent from FIG. 4, the flap portion 500 of the retaining flap 50 describes, together with a line L which points through the pivot axis (S) and through a point at which the flap portion 500 crosses the guiding portion 40 of the guide plate 4, an angle $\alpha$ which is greater than 90°. This has the effect that a force of the receptacle G conveyed against the flap portion 500 and retained at the flap portion 500 acts at least with a direction vector component in the adjusting direction A and can thus cause the retaining flap 50 to open. The force action of the receptacle G on the retaining flap 50 takes place predominantly in the conveying direction E. In this case, the receptacle G presses against the flap portion 500, wherein a force action occurs at the flap portion 500 on account of the inclination of the flap portion 500 toward the guiding portion 40 of the guide plate 4, said force action also being directed at least with a vector component in the direction of the adjusting direction A.

Because not all of the force exerted by the receptacle G on the flap portion 500 acts in the direction of the adjusting direction A, but merely a portion which corresponds to the amount of the force direction vector component that acts in the direction of the adjusting direction A, the pretensioning device 52 can be dimensioned in a comparatively small manner. In particular, the pretensioning device 52 does not have to provide and absorb all of the limit force, but merely the portion that acts in the adjusting direction A. In other words, the limit force, the exceeding of which results in the opening of the retaining flap 50 on account of the force action of the receptacle G on the flap portion 500, is greater than the force that the pretensioning device 52 provides.

It should be noted in this respect that the pretensioning device 52 already pretensions the retaining flap 50 in the initial position with respect to the guide plate 4 and thus to the housing 10, such that the retaining flap is held by force in its closed position.

In the exemplary embodiment, the flap portion 500 of the retaining flap 50, as illustrated in FIG. 5, is formed by spaced-apart blocking bars 505 which extend through slots 400 in the guiding portion 40 and thus mesh with the guiding portion 40. The blocking bars 505 project into the region between the guide plates 3, 4 and in this way block the exit opening 6 to prevent the passage of a receptacle G. The blocking bars 505 can be adjusted in the adjusting direction A out of this closed position and then move in the slots 400 so that the exit opening 6 is released.

The idea underlying the invention is not limited to the exemplary embodiments outlined above, but can also be realized in principle in embodiments of entirely different types.

In particular, advancing devices of quite different types are conceivable and usable in principle, wherein one or more advancing devices can be used for the unidimensional or multidimensional compacting of a receptacle.

For example, instead of an advancing roller, it is also possible to use advancing devices that use chain drives, cable drives, bands, belts or the like. Advancing devices that use advancing screws are also conceivable.

A plurality of advancing devices can in this case be arranged in such a manner with respect to one another that they form a hopper into which a receptacle can be thrown in order to be conveyed into the hopper and to be compacted by being guided through a narrowed end of the hopper.

In principle, the flap device can also adopt a completely different design. For example, a retaining flap of the flap device can also be arranged on a housing of a compacting apparatus so as to be movable or displaceable in some other way.

Likewise, it is in principle conceivable not to control adjustment of the flap device between its closed position and its open position in a spring-mechanical manner but for example using an electronic control device which measures a force exerted on the retaining plate by means of a suitable sensor system and causes the retaining flap to be opened in an electronically controlled manner when a predetermined limit force is exceeded.

LIST OF REFERENCE SIGNS

1 Compacting apparatus
10 Housing
100 Insertion hopper
101 Insertion opening
11, 12 Guiding surface
110 Pretensioning device
2 Advancing device (cutting unit)
20 Piercing tool
21 Disks
3 Guide plate (stripping tool)
4 Guide plate
40 Guiding portion
400 Slots
5 Flap device
50 Retaining flap
500 Flap portion
501, 502 Arm
503 Bearing element
504 Stabilizing arm
505 Blocking bars
51 Setting device
510 Setscrew
511 End
512 Nut
52 Spring element
6 Exit opening
A Adjusting direction
D Rotation axis
E Conveying direction
G Receptacle
G' Compacted receptacle
L Line
R Storage space
S Pivot point
V Direction of rotation

What is claimed is:

1. A compacting apparatus for compacting receptacles, comprising:

at least one advancing device for conveying a receptacle in a conveying direction to an exit opening of the compacting apparatus, the at least one advancing device being configured to act on the receptacle for compacting during conveying;

a flap device having an adjustable retaining flap that closes the exit opening in a closed position so that a receptacle conveyed against the retaining flap by the at least one advancing device is retained on the retaining flap, the retaining flap being adjustable out of the closed position to release the exit opening;

a moveable guiding surface, wherein an intermediate space is located between the movable guiding surface and the at least one advancing device, wherein the intermediate space is positioned along the conveying direction and receptacles travel through the intermediate space; and wherein the flap device is downstream of the at least one advancing device and the moveable guiding surface in the conveying direction.

2. The compacting apparatus of claim 1, wherein the retaining flap is pivotable about a pivot axis.

3. The compacting apparatus of claim 2, wherein the retaining flap is pretensioned toward the closed position.

4. The compacting apparatus of claim 3, wherein the retaining flap opens automatically when a force exerted by the receptacle on the retaining flap exceeds a predetermined limit force.

5. The compacting apparatus of claim 1, wherein the retaining flap is pivotable about a pivot axis that is offset with respect to the exit opening counter to the conveying direction.

6. The compacting apparatus of claim 1, wherein the retaining flap has a flap portion that closes the exit opening in the closed position.

7. The compacting apparatus of claim 6, wherein the flap portion is connected via at least one arm to a bearing element for pivotably mounting the retaining flap on a housing of the compacting apparatus.

8. The compacting apparatus of claim 6, wherein the flap portion is oriented with respect to the conveying direction in which the receptacle is conveyed against the flap portion during operation of the compacting apparatus, such that the receptacle conveyed against the flap portion exerts a force action on the flap portion, said force action being directed at least with one direction vector component in an adjusting direction in which the retaining flap is adjustable out of the closed position.

9. The compacting apparatus of claim 6, wherein the exit opening is formed between two guide plates for guiding the receptacle, the guide plates forming between one another a storage space into which the receptacle is intended to be conveyed, and the flap portion of the retaining flap bounding the storage space on an outlet side.

10. The compacting apparatus of claim 9, wherein the flap portion of the retaining flap describes, in the closed position, an angle of greater than 90° with a line that points through the pivot axis of the retaining flap and through a point of action of the flap portion on which a receptacle conveyed against the flap portion acts.

11. A compacting apparatus for compacting receptacles, the compacting apparatus comprising:

at least one advancing device for conveying a receptacle in a conveying direction to an exit opening of the compacting apparatus, the at least one advancing device being configured to act on the receptacle for compacting during conveying;

a flap device having an adjustable retaining flap that closes the exit opening in a closed position so that a receptacle conveyed against the retaining flap by the at least one advancing device is retained on the retaining flap, the retaining flap being adjustable out of the closed position to release the exit opening;

wherein the exit opening is formed between two guide plates; and wherein the flap device is at least partially formed by spaced-apart blocking bars that block the exit opening in the closed position, and in the closed position the blocking bars engage through slots in at least one of the guide plates.

* * * * *